US006460280B1

(12) United States Patent
Haines-Woon

(10) Patent No.: US 6,460,280 B1
(45) Date of Patent: Oct. 8, 2002

(54) FRAMELESS PICTURE MOUNT

(76) Inventor: Enid E. Haines-Woon, P.O. Box 26652, Tamarac, FL (US) 33320

( * ) Notice: Subject to any disclaimer, the term of this patent is extended or adjusted under 35 U.S.C. 154(b) by 0 days.

(21) Appl. No.: 09/538,746

(22) Filed: Mar. 30, 2000

Related U.S. Application Data

(60) Provisional application No. 60/148,706, filed on Aug. 16, 1999.

(51) Int. Cl.[7] ..... A47G 1/06
(52) U.S. Cl. ..... 40/768; 40/773
(58) Field of Search ..... 156/291; 40/768, 40/772, 773, 594

(56) References Cited

U.S. PATENT DOCUMENTS

| | | | | | |
|---|---|---|---|---|---|
| 220,159 | A | | 9/1879 | Laurense | |
| 561,480 | A | | 6/1896 | Booth | |
| 569,510 | A | | 10/1896 | McCabe | |
| 630,215 | A | * | 8/1899 | Gross | 40/768 |
| 1,968,674 | A | | 7/1934 | Engel | |
| 2,061,294 | A | | 11/1936 | Stephenson | |
| 2,401,495 | A | | 6/1946 | Martin | |
| 3,098,272 | A | | 7/1963 | Frye | |
| 3,350,045 | A | | 10/1967 | Mayers | |
| 3,687,770 | A | * | 8/1972 | Chase | 40/768 |
| 4,057,923 | A | | 11/1977 | Chase | |
| 4,217,710 | A | | 8/1980 | Becker | |
| 4,282,668 | A | | 8/1981 | Jolkovski | |
| 4,809,451 | A | | 3/1989 | Suzuki | |
| 5,279,692 | A | * | 1/1994 | Best et al. | 156/268 |
| 5,533,288 | A | | 7/1996 | Lambert | |

FOREIGN PATENT DOCUMENTS

| | | |
|---|---|---|
| GB | 635806 | 4/1950 |
| GB | 1370061 | 10/1974 |
| WO | 91/0974 | 7/1991 |

* cited by examiner

*Primary Examiner*—Cassandra H. Davis
(74) *Attorney, Agent, or Firm*—Richard C. Litman

(57) ABSTRACT

A frameless picture mount is formed of a series of flat, planar elements adhesively laminated together to form the complete assembly. A laminated backing board comprising a foam core sandwiched between opposed sheets of coated paper is used as a base for the assembly, with a flat, planar display article (photograph, picture, etc.) adhesively secured to the front of the backing board by a series of double sided adhesive tape strips. The display article is protected by a clear plastic laminating sheet which is adhesively sealed to the front of the article. A second such sheet may be used to seal the article completely between the two laminating sheets, to preclude migration of acids and/or chemicals between the display article and the papers or materials of the remainder of the assembly.

15 Claims, 5 Drawing Sheets

FRAMELESS PICTURE MOUNT

REFERENCE TO RELATED PATENT APPLICATION

This application claims the benefit of U.S. Provisional patent application Ser. No: 60/148,706 filed on Aug. 16, 1999.

BACKGROUND OF THE INVENTION

1. Field of the Invention

The present invention relates generally to display articles, signs, and the like adapted for display on a wall or other generally vertical surface, and more specifically to a frameless mount for pictures and the like. The present frameless mount comprises a backing board to which the picture or other flat display article is adhesively attached, with at least one transparent protective sheet and mat border being adhesively secured thereto. An assembly kit and method of assembling the present frameless picture mount are also disclosed.

2. Description of the Related Art

The use of relatively flat, planar decorative articles to brighten the interior walls of homes, offices, and other structure is of course well known. While in primitive quarters the mere tacking or nailing of a photo or the like to a wall may be done (e.g., in temporary military barracks or the like), more attractive displays and display means are generally preferred.

Accordingly, it has become customary to provide a relatively deep frame to surround a photo or other generally flat, planar article (photo, needlework sampler, etc.) and to use some form of mechanical means (screws, nails, etc.) to suspend the picture and frame assembly on a wall or the like. Mechanical fasteners are generally required with such assemblies due to the relatively heavy weight of the frame and backing for the display article, rather than due to the light weight of the display article itself.

The frames used for such display articles are often expensive particularly when custom framing work is done. It is recognized that in many instances a high quality, massive frame is desirable for the display of an article therein, but it should also be noted that there are likely many more occasions in which the use of such a costly and massive frame is unnecessary and even undesirable, as such a frame can detract from a relatively simple and clean picture or other display. Moreover, in many cases the use of mechanical fasteners to penetrate a wall surface is undesirable, and may not be permitted in many instances (apartments, dorms, etc.).

Accordingly, a need will be seen for a frameless picture mount which serves to protect a photograph, picture, or other generally flat, planar display article, while also providing a suitable border or margin for the work to provide a finished look for the assembly. The present frameless mount is very light in weight due to the materials used, and is easily secured to a wall or other suitable surface by adhesive means, rather than requiring mechanical fasteners which would penetrate the surface of the wall.

A discussion of the related art of which the present inventor is aware, and its differences and distinctions from the present invention, is provided below.

U.S. Pat. No. 220,159 issued on Sep. 30, 1879 to Nicholas C. N. Laurense, titled "Method Of Mounting Pictures," describes the use of a manila paper backing for mounting "chromos" or the like in a frame. The Laurense method requires a frame (or "stretcher"), across which the manila backing material is stretcher and wrapped about the back edges of the frame. The present frameless picture mounting does not require any lateral stretching of any of the components, but rather laminates all components in a predetermined order atop one another. Also, Laurense does not disclose any means of attaching his assembly to a wall or the like.

U.S. Pat. No. 561,480 issued on Jun. 2, 1896 to George R. Booth, titled "Mount For Pictures Or Photographs," describes an assembly comprising a sheet of glass or the like sandwiched between two opaque sheets of fiberboard or the like. Booth uses the glass for rigidity, rather than for transparency. The assembly is wrapped with a decorative paper covering, and the picture is glued to the front of the assembly, with no additional protective covering provided for the picture. Booth recognizes that his assembly is relatively heavy, with its glass central panel, and accordingly does not provide any means for hanging the assembly on a wall. Rather, he provides a brace in the back for supporting the assembly in a stand-up easel configuration, for display on a desk or the like, unlike the present frameless picture mount invention.

U.S. Pat. No. 569,510 issued on Oct. 13, 1896 to James W. McCabe, titled "Art Of Manufacturing Photographic Mounts," describes an assembly using shellac or other, adhesive means for assembling a decorative border and panel on a cardboard backing sheet. McCabe does not disclose any means of mounting as picture to his completed mount assembly, whereas the present frameless picture mount assembles the picture as an integral part of the assembly, immediately adjacent the backing material, rather than being placed atop the remainder of the completed assembly, as in the Mccabe assembly. Also, McCabe does not provide any means of mounting or attaching his assembly to a wall or other similar suitable surface, as provided by the present frameless picture mount invention.

U.S. Pat. No. 1,968,674 issued on Jul. 31, 1934 to Albert W. Engel, titled "Transparent Mounting Device," describes an opaque backing sheet having a rear gummed surface and foldable transparent overlay sheet. The picture is placed upon the front of the backing sheet, and the transparent overlay is placed thereover with the oversize edges being folded around the back of the backing sheet and adhesively secured thereto. Engel provides tabs of material from the backing sheet, which may be passed through slots in the folded over transparent sheet for use in securing the assembly in an album or the like, and also cuts slots in the center of the backing for folding forwardly to adhesively secure the back of the picture to the backing sheet. No adhesively coated transparent overlay or mat border is provided by Engel, and his adhesive attachment means is different from that of the present invention.

U.S. Pat. No. 2,061,294 issued on Nov. 17, 1936 to William G. Stephenson, titled "Display Device And Process Of Making The Same," describes a rigid backing board with a picture placed on the front surface thereof, with a sheet of transparent cellulose material positioned over the picture. Stephenson spreads a thin cellulose solvent along the border of the backing material before covering the picture and backing board with the cellulose sheet, with the solvent shrinking the marginal edge of the cellulose slightly to provide a wrinkle-free covering. However, Stephenson fails to attach the picture securely to the backing board (he provides only one small optional adhesive attachment point) and more importantly, does not provide any form of mat border for the assembly to provide a finished look, as is done with the present frameless assembly. Moreover, Stephenson does not provide any means of adhesively securing the completed assembly to a wall or the like, as is done with the present mounting system.

U.S. Pat. No. 2,401,495 issued on Jun. 4, 1946 to William Martin, titled "Picture Frame," describes an assembly comprising an opaque backing board with a glass sheet overlay, the picture being sandwiched between the backing board and glass sheet. Martin also provides a border of mirrored glass tiles, with a further decorative trim border overlay on the tiles. Martin further provides a strap for hanging the assembly, with the strap ends being secured between the mirrored tiles and glass sheet, whereas the present assembly uses adhesive means for attaching the lightweight structure to a wall or the like.

U.S. Pat. No. 3,098,272 issued on Jul. 23, 1963 to Bruce J. Frye, titled "Self Adhesive Clip And Method," describes a clip which secures to the edge of a thin sheet of material (photograph, etc.) and which utilizes the principal of molecular adhesion between two extremely smooth and closely mating surfaces to secure the clips to another surface (glass window, etc.). The Frye clips do not support the picture from behind; do not provide adhesive attachment of the picture to another article, or to the clips themselves; do not provide a transparent protective sheet overlay adhesively secured to the picture; do not provide for a mat border for the picture; and cannot adhere to the relatively rough surface of a conventional wall, due to the molecular adhesion principle used. Each of the above limitations is overcome by the present frameless picture mount and method.

U.S. Pat. No. 3,350,045 issued on Oct. 31, 1967 to Lawrence S. Mayers, titled "Article Holder;" describes the use of spring clip channel sections for gripping the edge of a thin, flat article (sheet of paper, picture, etc.). In one embodiment, four, such elongate sections are clipped to the four edges of a rectangular picture, with small sections of double sided adhesive material being shown in other embodiments for attaching one of the strips to a wall or other suitable surface. However, the Mayers system comprises a frame which surrounds the edges of the picture when used as described above, whereas the present mounting system is frameless. Moreover, Mayers does not disclose any form of transparent protective coating for a picture installed in his frame.

U.S. Pat. No. 4,057,923 issued on Nov. 15, 1977 to Marston Chase, titled "Adhesive Picture Mount," describes a system of multiple laminates which serve to assure that a picture is accurately aligned relative to, the backing sheet and/or border. None of the embodiments of the Chase assembly, provide a transparent protective overlay for the picture set therein, nor does Chase provide any means of securing the assembly to a wall or the like for display, either by adhesive or mechanical fastening means. The Chase disclosure primarily describes the means of attaching the various components and picture together using double sided adhesive sheets with release sheets, by partially peeling the release sheet from one side and attaching the components in registry at that point, then progressively removing the remaining release sheet while smoothing the components together.

U.S. Pat. No. 4,217,710 issued on Aug. 19, 1980 to Rolf Becker, titled "Frameless Support For Pictures," describes the specific structure of a clip which may be used for securing a backing board, a picture or the like, and a cover plate (e. g., glass) together. A series of such clips is required about the edges of the assembly, with the fastening means being purely mechanical, rather than adhesive as in the present assembly. No mat border nor adhesive means of securing the assembly to a wall or the like is disclosed by Becker, which features are a part of the present frameless picture mount invention.

U.S. Pat. NO. 4,282,668 issued on Aug. 11, 1981 to Robert M. Jolkovski, titled "Mounting System And Method," describes a clip system bearing a stronger resemblance to the clips of the Becker '710 U.S. Patent discussed immediately above, than to the present invention. Jolkovski uses a secondary anchor which digs into the backing material and a spring connecting an edge clip to the secondary anchor. The backing sheet, picture, and glass overlay are all held together mechanically by the edge clips, rather than being adhesively secured together, as in the present system. Moreover, Jolkovski utilizes a relatively heavy glass protective cover for the picture, as does Becker and others noted further above. The weight of the glass generally precludes safe adhesive attachment to a wall or the like, and accordingly, Jolkovski is silent regarding any means of suspension for his assembly.

U.S. Pat. No. 4,809,451 issued on Mar. 7, 1989 to Eiichi Suzuki, titled "Method For Protecting A Print," describes the use of a backing board or sheet with an open overlay sandwiching a picture therebetween. The overlay is in the general form of a mat border, with the picture being visible through the open center thereof. The two sheets are adhesively secured together, but Suzuki does not use any means for adhesively securing the picture to the backing board other than by capturing the border between the back and overlay. While Suzuki provides a transparent protective sheet, he places it over the border, rather than beneath it, as in the present assembly. Moreover, Suzuki does not provide any means of securing his assembly to a wall or other structure.

U.S. Pat. No. 5,533,288 issued on Jul. 9, 1996 to Gary F. Lambert, titled "Quick Mount Picture Frame," describes an assembly including a frame, as indicated by the title of the patent. The Lambert frame is relatively deep and heavy, in comparison with the present frameless mount structure. A mat border is provided which fits completely within the frame, whereas the mat border of the present assembly is devoid of any frame surrounding it. The picture held within the Lambert assembly is even smaller than the mat border, thus resulting in relatively little picture area in comparison to the area exposed in the present frameless assembly. Moreover, Lambert does not provide any transparent protective overlay for a picture in his framed assembly, nor does he provide any adhesive means of securing the assembly to a wall, as provided by the present frameless picture mount.

British Patent Publication. No. 635,806 published on Apr. 19, 1950 to Emile H. du Heume, titled "Improvements In Or Relating To Passe-Partout Mounting Of Pictures And The Like And Clips For Use Therein," describes the use of a plurality of clips more closely resembling the clip arrangement disclosed in the Becker '710 and Jolkovski '668 U.S. Patents discussed further above, than to the present frameless picture mount invention. Du Heume uses such mechanical clips due to the weight of the glass protective overlay sheet he uses in his assembly. Du Heume does not disclose any adhesive means for securing any of his assembly together, nor doe he provide any form of mat border or adhesive means for securing his mount to a wall, all of which are provided by the present mount.

British Patent Publication No. 1,370,061 published on Oct. 9, 1974 to Lamson Paragon Ltd., titled "Improvements In Or Relating To Support Means For Information Sheets," describes a pair of sheets adhesively secured together. The top sheet includes a series of separable strips cut therein, which expose the adhesive of the underlying sheet when removed. A progressive series of reports or the like may then be adhesively attached to the sheet, by means of the adhesive exposed when each strip is removed. The '061 British Patent Publication does not teach any provision for a mat border, and in fact teaches away from any transparent protective overlay, as such would defeat access to the strips for removal thereof and attachment of documents to the sheet. Also, no means of adhesively attaching the assembly to a wall or the like is provided by the '061 British Patent Publication.

Finally, PCT Patent Publication No. WO 91/0974 published on Jul. 11, 1991 to Richard M. Cohart, titled "Mat Structure And Method Of Matting A Picture," describes a series of three mats and a backing sheet. A bottom mat has an interior opening sized to fit the picture, with an intermediate mat also fitting within the bottom mat opening. An uppermost mat holds the other mat and picture assembly to the backing sheet. Cohart does not provide any transparent overlay, and the picture is not adhesively secured in place, as is the case with the present picture mount. Also, Cohart does not provide any wall attachment means for his structure.

None of the above inventions and patents, either singly or in combination, is seen to describe the instant invention as claimed.

SUMMARY OF THE INVENTION

The present invention comprises a frameless picture mount, using a series of different adhesive attachments for laminating the various components of the frameless mount together. A backing board having a foam core sandwiched between opposed coated paper sheets is used to support the assembly. A flat, planar display article (picture, photograph, etc.) is adhesively secured to the front surface of the backing board by means of a plurality of double sided adhesive tape strips. The display article is protected by a sheet of clear, adhesively coated plastic laminate which is used to overlay the article; the article may be protected on its reverse side by a similar clear or opaque laminate sheet, in order to preclude damage to the article by acids in the paper, and/or to preclude chemicals from a photographic print migrating to the papers of the assembly. The display article is slightly smaller than the laminate sheet(s), in order provide a complete seal about the edges of the display article.

In turn, the laminate sheet(s) is/are slightly smaller than the backing board, in order to provide a margin for gluing a mat border atop the remainder of the assembly. This permits the mat border to be adhesively secured directly to the underlying edge of the backing board, as the plastic laminate sheet(s) would not provide a suitable base for the adhesion of the glue adhesive. Finally, another double sided adhesive strip is applied to the back of the assembly, with the second release strip remaining in place until the assembly is adhesively secured to a wall for display.

Accordingly, it is a principal object of the invention to provide an improved frameless picture mount providing for the display of a flat, planar display article therein.

It is another object of the invention to provide an improved frameless picture mount comprising a laminated backing board, a display article adhesively secured thereto, at least one protective sheet of clear plastic laminate adhesively overlying the display article, and a mat border adhesively secured to the front of the assembly.

It is a further object of the invention to provide an improved frameless picture mount in which a second plastic laminate sheet is applied to the back of the display article. to preclude the migration of acids and/or chemicals between the display article and adjacent papers of the assembly.

An additional object of the invention is to provide an improved frameless picture mount in which the display article is slightly smaller than the protective laminate sheet (s) applied thereto, with the laminate sheet(s) being slightly smaller than the backing board and mat border, for adhesively securing the mat border directly to the backing board.

Still another object of the invention is to provide an improved frameless picture mount including adhesive means for securing the assembly to a wall or other suitable structure.

Yet another object of the invention is to provide a kit for the assembly of a frameless picture mount with a picture, and method of assembly of the picture mount kit with the picture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
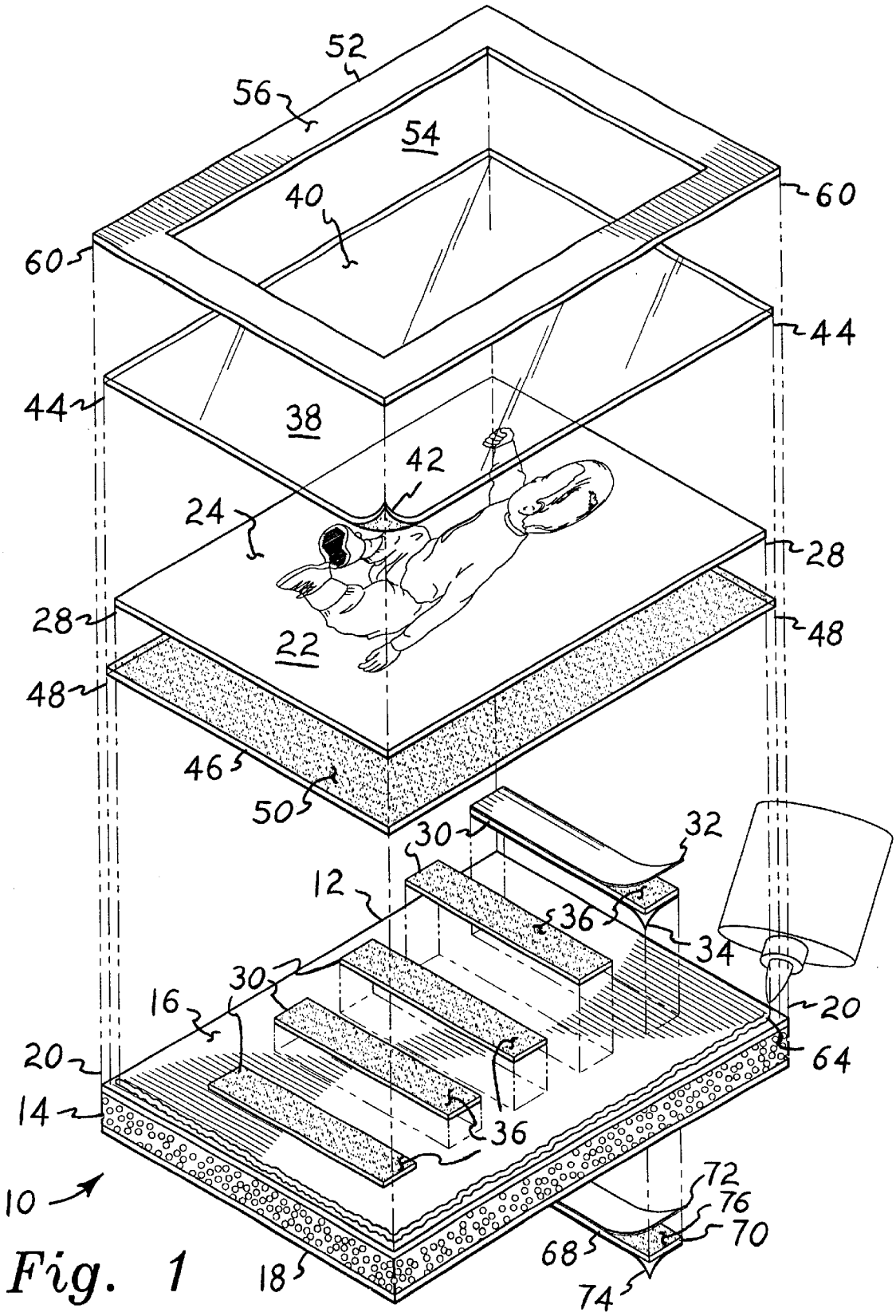
FIG. 1 is an exploded perspective view of the present frameless picture mount, illustrating the various components thereof.

The present invention comprises a frameless picture mount, providing a lightweight means of displaying a flat, planar display article (photograph, picture or art print, etc,) therein. A kit of the components of the present picture mount is also provided, for assembling a picture or the like therein. The various components of the present picture mount are illustrated in the exploded perspective view of FIG. 1, with the assembly being designated by the reference numeral 10 throughout the drawing Figures. The backing board 12 of the picture mount assembly 10 is formed of a rigid, lightweight sheet of material having a foam plastic core 14 sandwiched between first and second sheets of coated paper or other suitable material, with the first and second coating sheets respectively comprising a front surface 16 and an opposite back surface 18. The backing board 12 is cut to size according to the size of the artwork or display article to be displayed therein, with the periphery 20 of the board 12 remaining open.

A thin, flat, planar display article 22 (e. g., photograph, art print, etc.) includes a front or display surface 24, an opposite back or attachment surface 26 (shown in FIG. 3), and a periphery 28. The periphery 28 of the display article 22 is cut so that it is slightly smaller in all dimensions than the periphery 20 of the backing board 12, or more preferably, the periphery 20 of the backing board 12 is cut to be slightly larger than the periphery 28 of the display article 22, in order to avoid undue cutting or trimming of the display article 22.

The back surface 26 of the display article 22 is secured symmetrically to the front surface 16 of the backing board 12, with the opposite front or display surface 24 of the display article 22 oriented outwardly for viewing. The slightly smaller periphery 28 of the display article 22 relative to the periphery 20 of the backing board 12, leaves a narrow exposed, outer edge about the front surface 16 of the backing board 12 after the display article 22 is secured thereto; this exposed outer edge of the backing board 12 comes into play in the assembly of the present frameless picture mount, as described further below. The display article 22 may be attached to the backing board 12 by a plurality of double sided contact adhesive tape strips 30 having first or front and opposite second or back release sheets, respectively 32 and 34, protecting the adhesive coating 36 on each side thereof before application.

The first or front release sheets 32 are removed from each of the adhesive strips 30 (with one such release sheet 32 being shown partially removed in FIG. 1), and the exposed front adhesively coated surfaces 36 are applied to the back surface 26 of the display article 22. The remaining back release sheets 34 are then removed from the back surfaces of the adhesive strips 30 to expose the adhesive coating thereon, and the display article 22 is positioned symmetrically upon the front surface 16 of the backing board 12 and pressed in place, with the contact adhesive of the strips 30 securing the display article 22 and backing board 12 together. (The order of assembly may be reversed if desired, with the adhesive tapes first being applied to the backing board.)

Preferably, the display article 22 is protected by a transparent plastic overlay or lamination sheet 38 secured over the front surface 24 thereof. The lamination sheet 38 includes an uncoated front surface 40 and an opposite back surface 42 which is coated with a contact adhesive (as shown by the upturned corner in FIG. 1), and provides for complete adhesive sealing of the surface of any flat article to which it is applied. The lamination sheet 38 is cut or trimmed to have a Periphery 44 which fits between the slightly larger periphery 20 of the backing board 12, and the slightly smaller periphery 28 of the display article 22. Thus, the adhesively coated outer edge of the laminate sheet 38 extends slightly beyond the edge of the display article 12, to adhesively secure to the surface lying below the display article 12 and thus completely seal the display article 12 to the underlying surface and precluding any exposed edges for the display article 12.

The present frameless picture mount assembly 10 may also include a second adhesively coated laminate sheet 46, similar to the first lamination sheet 38 described above. The second laminate sheet 46 is also cut or trimmed to the same size as the first laminate sheet 38, i. e., the periphery 48 of the second laminate sheet 46 is congruent with the periphery 44 of the first laminate sheet 38 when the two are placed in registry with one another. This second laminate sheet 46 is adhesively applied between the display article 22 and the backing board 12, before the display article 22 is adhesively secured to the backing board 12.

However, the orientation of the second sheet 46 is reversed, with its adhesively coated second surface 50 being oriented upwardly or forwardly, i. e., toward the first laminate sheet 38, rather than toward the backing board 12. Thus, the first and second laminate sheets 38 and 46 sandwich the display article 22 therebetween, with the slightly larger peripheries of the laminate sheets 38 and 46 extending slightly beyond the periphery 28 of the display article 22 and adhesively sealing to one another, generally as shown in the cross sectional view of FIG. 3 of the drawings.

Figure 3:
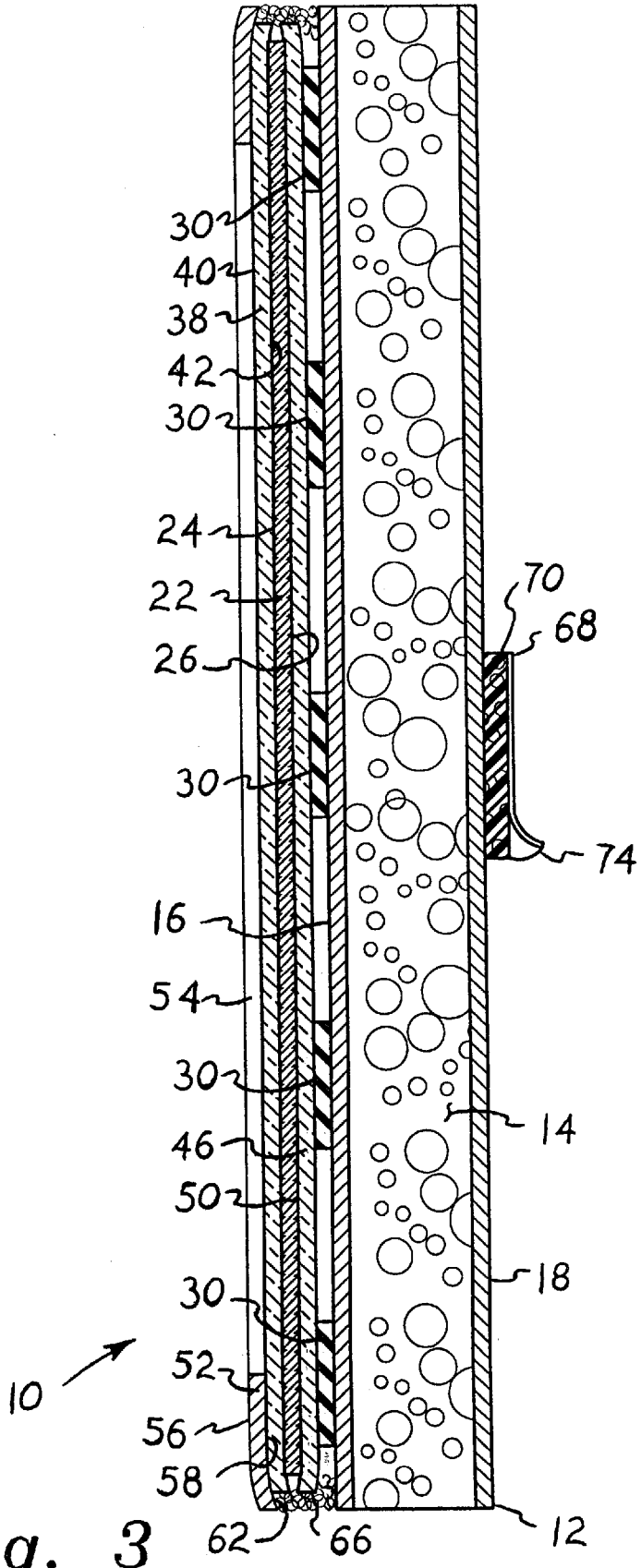
FIG. 3 is a side elevation view in section of the completed frameless picture mount of FIG. 2, showing details of the assembly.

It will be seen that the thicknesses of the various sheets of material used in the present frameless picture mount assembly 10 are exaggerated considerably in most cases, in order to provide the required clarity in the drawing Figures. In reality, the peripheral edges of the two lamination sheets 38 and 46 would be adhered together about the smaller periphery of the relatively thin display article 22, rather than being separated by a substantially thick display article 22, as shown in FIG. 3. This sealing of the two mating edges of the adhesively coated surfaces 42 and 50 of the two laminate sheets 38 and 46, serves to completely encapsulate and seal the display article 22 therein, thus precluding any migration of acids and/or other residual chemicals in the papers and materials of the assembly into the display article 22 to discolor or otherwise damage the display article 22, and also precluding any migration of residual chemicals from a photograph display article 22 into the surrounding structure of the assembly 10.

The above described assembly is topped by a conventional mat border 52 of matte paper, fiberboard, or other suitable material as desired. The mat border 52 includes a conventional opening 54 therein sized for viewing the display article 22 of the assembly, and a front surface 56 and opposite back surface 58 (shown in FIG. 3). The outer periphery 60 of the mat border 52 is cut to be congruent with the periphery 20 of the backing board 12 when the border 52 and backing board 12 are placed in registry with one in other, i. e., the periphery 60 of the mat border 52 is slightly larger than the peripheries 44 and 48 respectively of the first and second lamination sheets 38 and 46, and even further slightly larger than the periphery 28 of the display article 22.

The extension of the congruent peripheries 20 and 60 of the respective backing board 12 and mat border 52 beyond the periphery 28 of the display article 22 (and peripheries 44 and 48 of the respective first and second laminate sheets 38 and 46), define an attachment edge 62 disposed about the back surface 58 of the mat border 52, immediately inwardly from the periphery 60 thereof. A seam of viscous liquid adhesive 64 (or a strip of tape, as used in other assemblies) is applied to the attachment edge 62 of the mat border 52 (or to the congruent area of the front surface 16 of the backing board 12, as shown in FIG. 1), and the mat border 52 is secured in registry with the backing board 12 to sandwich the edge of the display article 22 (and edges of the first and second laminate sheets 38 and 46) between the mat border 52 and backing board 12, essentially completing the assembly of the device.

It will be seen that the attachment edge 6 of the mat border 52 is adhesively secured directly to the outer edge of the front surface 16 of the backing board 12, as the smaller peripheries 28 of the display article 22 (and peripheries 44 and 48 respectively of the first and second laminate sheets 38 and 46) remain clear of the mat border to backing board attachment area defined by the attachment edge portion 62 of the mat border 52; this relationship of components is clearly shown in the cross sectional view of FIG. 3. Thus, the adhesive 64 remains clear of any plastic material of the first and second laminate sheets 38 and 46, to which the adhesive 64 would provide a less than satisfactory bond, to provide a solid bond directly between the front surface 16 of the backing board 12 and the attachment edge 62 of the mat border 52.

Again, the thickness of the various sheets of material comprising the present assembly is generally greatly exaggerated in the cross section of FIG. 3. In reality, the cured adhesive seam 66 shown in FIG. 3 would comprise a much smaller thickness, with the gap between the mat border 52 and front surface 16 of the backing board 12 being considerably thinner than that shown in FIG. 3 of the drawings. While the backing board 12 would be relatively thick in comparison to the thickness of other components, due to the thickness of the foam core, the thicknesses of other sheet materials used is conventional, and comprises at most only a small fraction of an inch in each case.

The assembly 10 is completed by applying some form of attachment means to the back surface 18 of the backing board 12, for securing the frameless mount 10 to a wall or other structure as desired. As the present frameless mount 10 is extremely light in weight due to the foam core 14 of the backing board 12 and the thinness of the other sheet materials comprising the assembly, a relatively light weight adhesive attachment means may be used. A double sided contact adhesive tape strip 68 having a resilient foam core 70 (for filling any irregularities in a wall surface or the like) is particularly suitable for such adhesive attachment means for the present frameless picture mount 10.

The tape strip 68 is provided with opposite first or front and second or back release sheets, respectively 72 and 74, protecting and covering its respective adhesively coated surfaces before use. The first release sheet 72 is peeled from the corresponding adhesively coated surface 76 of the tape 68, and the tape 68 is adhesively secured to the back surface 18 of the backing board 12, generally as shown in FIGS. 1 and 3. The second release sheet 74 remains in place to preclude the tape from inadvertently sticking or adhesively securing to some other article before final installation of the frameless picture mount assembly 10 in the desired location.

When installation of the present frameless picture mount upon a wall or other suitable surface is desired, the second release sheet 74 is removed from the back surface of the tape 68 to expose the adhesive coating thereon, with partial removal of the second release sheet 74 being shown in FIGS. 1 and 3. The assembly 10 is then adhesively secured to the desired location by means of the contact adhesive surface (not shown, but identical to the first adhesive surface 76 shown in FIG. 1) exposed by removal of the second release sheet 74.

Figure 4:
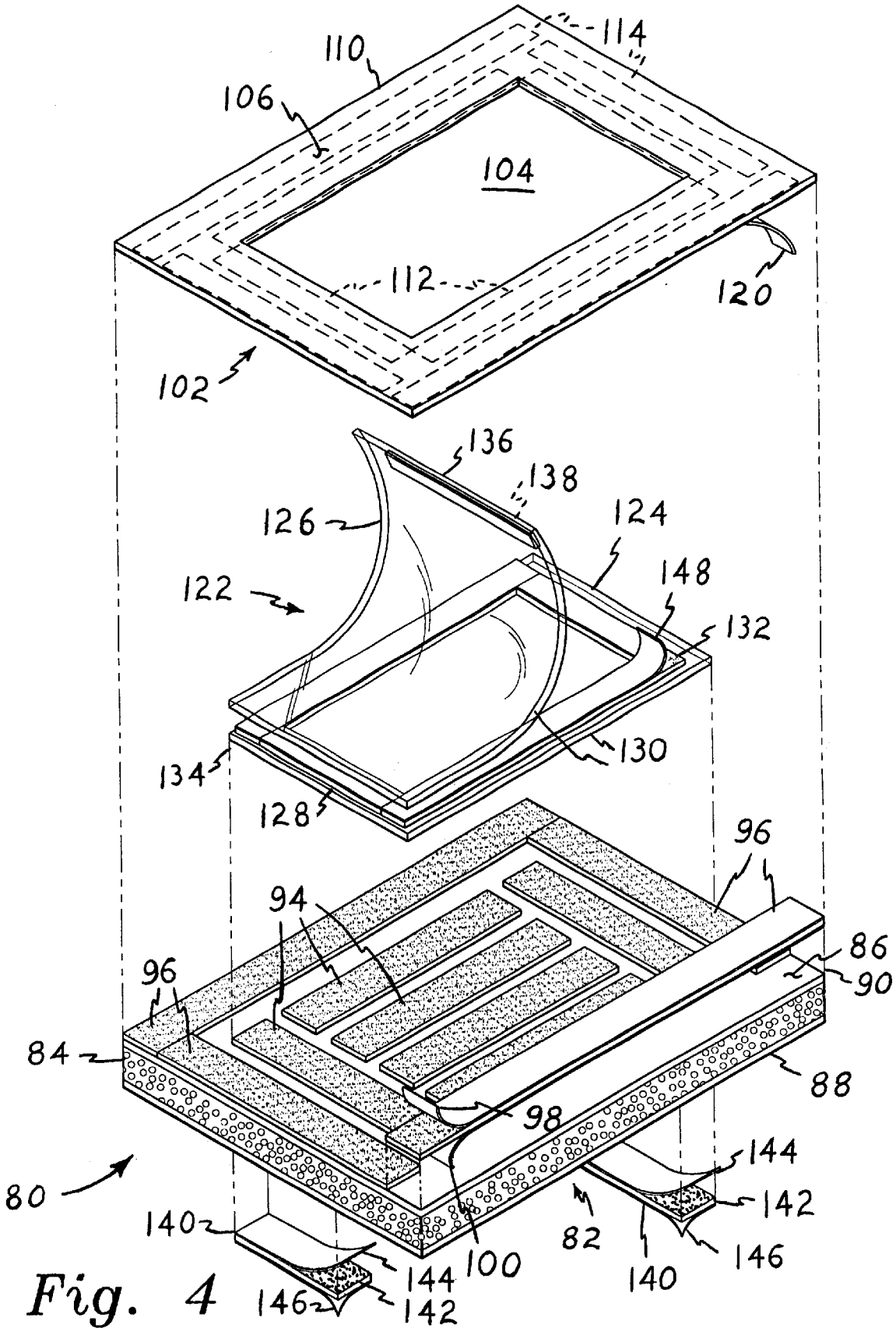
FIG. 4 is an exploded perspective view of a kit for the assembly of the present frameless picture mount, showing the various components thereof.
Figure 5:
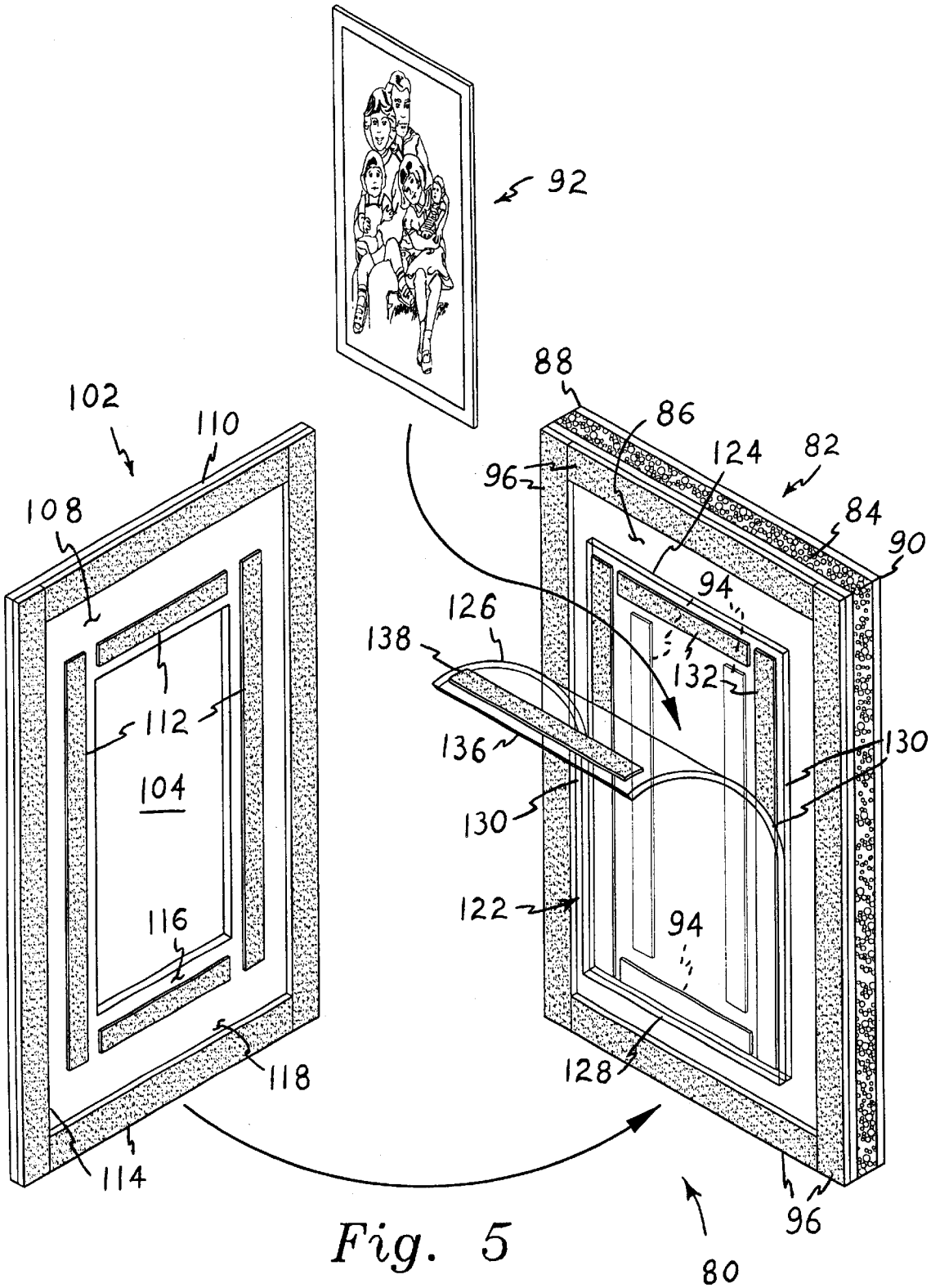
FIG. 5 is an exploded perspective view of the semi-assembled kit of FIG. 4, showing the installation of a picture or the like therein.

FIGS. 4 and 5 illustrate the assembly of various components to form a kit 80 for a frameless picture mount, and the process of installing a display article (photograph, flat artwork, etc.) within the kit 80. The backing board 82 of the picture mount kit 80 is formed of a rigid, lightweight sheet of material having a foam plastic core 84 sandwiched between first and second sheets of coated paper or other suitable material, with the first and second coating sheets respectively comprising a front surface 86 and an opposite back surface 88. The backing board 82 is cut to size according to the size of the artwork or display article to be displayed therein, with the periphery 90 of the board 82 remaining open, in the manner of the picture mount 10 of FIGS. 1 through 3. A series of adhesive central attachment tapes 94 and peripheral attachment tapes 96 are applied to the front surface 86 of the backing board 82, respectively for securing a display article (or transparent protective sheets) and a mat border to the backing board 82, as discussed further below.

Figure 2:
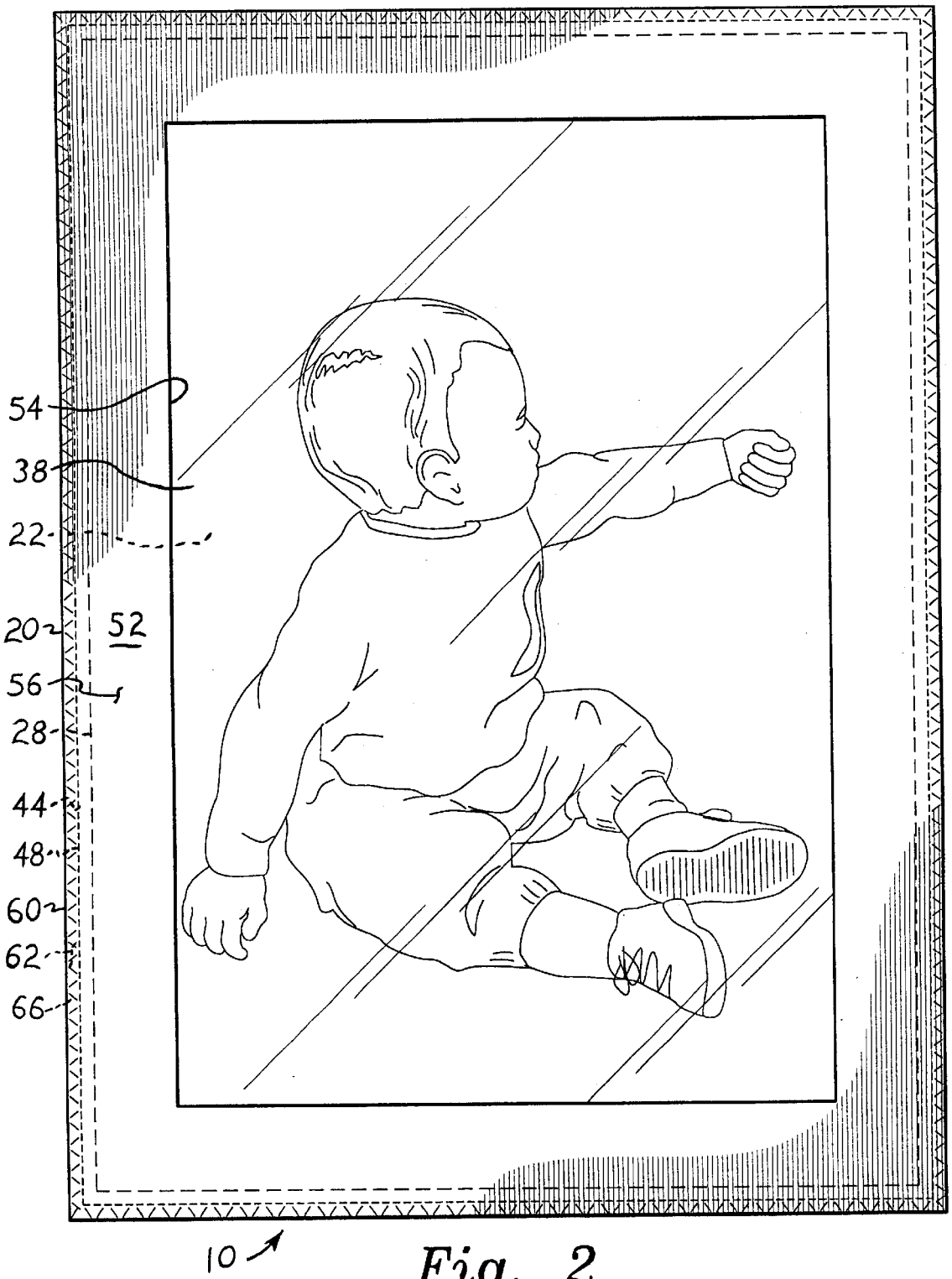
FIG. 2 is a front elevation view of a completed assembly of the present frameless picture mount, with an exemplary picture displayed therein.

The central and peripheral tapes 94 and 96 are essentially equivalent to the tapes 30 used in the construction of the picture mount 10 of FIGS. 1 through 3, and comprise a double sided adhesive tape core sheet sandwiched between opposite removable release sheets 98 and 100; only one of the top and bottom release sheets 98 and 100 is illustrated in FIG. 4, as the tapes 94 and 96 would normally be applied to the backing board 82 at the time of kit manufacture with the protective transparency being applied to the exposed adhesive of the central tapes 94 at that time.

A conventional mat border 102 of matte paper, fiberboard, or other suitable material is supplied with the kit 80, for applying to the periphery of the backing board 82 after placing the flat display article 92 thereon. The mat border 102 includes a conventional opening 104 therein sized for viewing the display article 92 of the assembly, and a front surface 106 and opposite back surface 108 (shown in FIG. 5). The outer periphery 110 of the mat border 102 is cut to be congruent with the periphery 90 of the backing board 82 when the border 102 and backing board 82 are placed in registry with one in other, i. e., the periphery 110 of the mat border 102 is somewhat larger than the periphery of the display article 92 placed therein., The back surface 108 of the border 102 is provided with double sided adhesive tape strips, comprising a plurality of article attachment tapes 112 and a plurality of border attachment tapes 114, for securing the border 102 to the underlying backing board 82 and capturing the display article 92 therebetween.

The tape strips 112 and 114 are preferably double sided adhesive tapes, which have been applied respectively to the inner face area 116 and attachment edge 116 of the back surface 108 of the mat border 102. The first or mat attachment release sheets of each of the tapes 112 and 114 are removed at the time the kit is manufactured, with the tapes 112 and 114 being applied to the back surface 108 of the mat border at that time. However, the second release sheets 120 (one of which is illustrated in FIG. 4) remain on the tapes 112 and 114 until the kit is assembled, with the second release sheets 120 being removed at that point to secure the mat border to the underlying backing board 82 by means of the border attachment tapes 114 and to the article 92 (or its protective transparency) sandwiched between the mat border 102 and backing board 82 by means of the article attachment tapes 112.

Preferably, some form of display article protection means is provided between the backing board 82 and the mat border 102. This protection means may comprise a transparent envelope or folder 122 having a first or back sheet 124 which is adhesively secured to the front surface 86 of the backing board 82 by means of the central attachment tapes 94 which were previously adhesively secured to the backing board 82. A second transparent sheet 126 is provided for protecting the front of the display article 92, with the two sheets 124 and 126 being joined at a single common edge 128. The open edges 130 of the envelope 122 are provided with a series of double sided tape strips 132, for essentially sealing the envelope 122 about the display article 92 when assembled.

The transparent folder or envelope assembly 122 has a periphery 134 which is somewhat smaller than the peripheries 90 of the backing board 82 and mat border 102, as shown in FIG. 4 of the drawings, in order for the peripheral tapes 96 and border tapes 114 respectively of the backing board 82 and mat border 102 to contact and adhere directly to one another, rather than having the sheets 124 and 126 of the envelope assembly 122 disposed therebetween. In turn, the kit assembly 80 is dimensioned so that the interior of the transparent envelope assembly 122 is somewhat larger than the dimensions of the display article 92 for which the kit 80 is intended, as is clear from FIG. 5 of the drawings.

Thus, the display article 92 may be inserted between the two transparent leaves 124 and 126 of the envelope 122, with the envelope tapes 132 sealing the otherwise open edges 130 of the two leaves 124 and 126 together, thereby sealing the display article 92 therebetween. The front leaf 126 may have an extension 130 of the two opposite the joined edge 128 with an additional tape strip 138 thereon, to seal the open edge extension 136 directly to the underlying backing board 82. As in the picture mount 10 of FIG. 1 through 3, this essentially completely encapsulates and seals the display article 92 within the envelope 122 to preclude any migration of acids and/or other residual chemicals in the papers and materials of the assembly into the display article 92 to discolor or otherwise damage the display article 92, and also precludes any migration of residual chemicals from a photograph display article 92 into the surrounding structure of the kit 80.

The kit 80 is completed by applying some form of attachment means to the back surface 88 of the backing board 82, for securing the frameless mount 80 to a wall or other structure as desired, as in the case of the frameless mount 10 of FIGS. 1 through 3. As the present frameless mount kit 80 is extremely light in weight due to the foam core 84 of the backing board. 82 and the thinness of the other sheet materials comprising the assembly, a relatively light weight adhesive attachment means may be used. A double sided contact adhesive tape strip 140 having a resilient foam core 142 (for filling any irregularities in a wall surface or the like) is particularly suitable for such adhesive attachment means for the present frameless picture mount kit 80.

The tape strip 140 is provided with opposite first or front and second or back release sheets, respectively 144 and 146, protecting and covering its respective adhesively coated surfaces before use. The first release sheet 144 is peeled from the corresponding adhesive core 142 of the tape 140 at the time of construction of the kit 80, and the tape 140 is adhesively secured to the back surface 88 of the backing board 82 generally as shown in FIG. 4. The second release sheet 146 remains in place until the display article 92 is installed in the kit 80, to preclude the tape 140 from inadvertently sticking or adhesively securing to some other article before final installation of the frameless picture mount assembly 80 in the desired location.

The present kit 80 for a frameless picture mount is partially assembled before use, by applying the central and peripheral tapes 94 and 96 to the front surface 86 of the backing board 82. The release sheets of the central tapes 94 are removed, and the back sheet 124 of the transparent protective envelope 1221s adhesively secured to the front surface 86 of the backing board 82. The protective release sheets of the peripheral, tapes 96 on the board 82 remain in place to preclude adhesive attachment of the front surface 86 of the backing board 82 to other components until the kit 80 is completely assembled. The mounting or attachment tape (s) 140 may be applied to the back surface 88 of the backing board 82 at this time, if so desired, or both release sheets 144 and 146 may be left in place on the adhesive core(s) 142 to provide the option of installation of these tape(s) 140 to the consumer if so desired.

Tapes 132 are applied to the facing border portions of at least one of the two leaves 124 and 126 of the envelope 122, with the second release sheets 148 (i. e., those release sheets adjacent the opposite leaf) remaining in place until final installation of the display article 92 therein. Article and border securing tapes 112 and 114 are applied to the back surface 108 of the mat border 102, by removing one of their release sheets and adhesively securing the tapes 112 and 114 in place on the back surface 108 of the mat border 102, generally as shown in FIGS. 4 and 5. The second release sheets 120 remain in place on these tapes 112 and 114 until final assembly, to preclude adhesive contact of the back surface 108 of the mat border 102 with any other articles.

The above assembly essentially describes the present kit 80 as it is shown in FIG. 5 of the drawings (with some additional assembly being shown in FIG. 5), as it would be provided to the consumer for mounting a photograph or other flat display article 92 therein. At this point, the consumer or user need only insert the desired display article 92 between the two leaves 124 and 126 of the transparent protective envelope 122, remove the release sheets 148 from the tapes 132 of the border portions of the, envelope 122, and seal the edges of the two leaves 124 and 126 to one another by means of the tape 132 to seal the display article 92 therebetween. The release sheets 98 and 120 are then removed from the facing surfaces of the respective peripheral tapes 96 and 114 of the backing board 82 and mat border 102 and the two components 82 and 102 are adhesively secured in registry to one another, to complete the assembly.

When installation of the present frameless picture mount kits 80 upon a wall or other suitable surface is desired, the mounting or attachment tape(s) 140 may be applied to the back surface 88 of the backing board 82, if not previously applied thereto. The second release sheet 146 is then removed from the back surface of the mounting tape 140 to expose the adhesive coating thereon, with partial removal of the second release sheet 146 being shown in FIG. 4. The assembly 80 is then adhesively secured to the desired location by means of the adhesively coated core 142 exposed by removal of the second release sheet 146.

In summary, the present frameless picture mount provides a much needed means of quickly, inexpensively, and attractively displaying an art print, photograph, or other thin, flat, planar display article as desired. The present picture mount also provides proper protection for such a display article, by means of the clear plastic laminate sheet which may be applied to the front or display surface thereof. The use of a second such sheet to cover the back of the display article, provides even further protection from acids and/or chemicals which may migrate between the materials used in the present mount, and the article displayed therein. The extremely light weight of the present assembly enables it to be secured together using only adhesive means, with no mechanical fasteners or tools being required, other than cutting tools required in any event to cut the display article and/or mat border and backing board to size as desired.

The ease of assembly of the present frameless picture mount provides for the materials and components of the present mount to be provided in kit form, if so desired. Users of such a kit may acquire a kit having border or peripheral dimensions compatible with the display article to be assembled therein, with relatively little cutting or trimming being required of the display article with kit components of appropriate dimensions. Thus, the present frameless picture mount will prove attractive to a great number of people who have need to provide a simple, rapid, inexpensive, and yet attractive means for the display of a photograph, art print, or other thin, flat, planar display article.

It is to be understood that the present invention is not limited to the sole embodiment described above, but encompasses any and all embodiments within the scope of the following claims.

I claim:

1. A frameless picture mount, comprising:

a rigid, lightweight backing board having a first sheet of coated paper including a front surface, a second sheet of coated paper including a back surface opposite said front surface, a rigid, lightweight sheet of material having a foam plastic core sandwiched between each said first and second sheet of coated paper, and a periphery;

a thin, flat, planar display article having a front surface, a back surface opposite said front surface, and a periphery, with said periphery of said display article being smaller than said periphery of said backing board;

said back surface of said display article being adhesively secured symmetrically to said front surface of said backing board with said periphery of said backing board extending evenly beyond said periphery of said display article;

a mat border having a front surface, a back surface opposite said front surface, an outer periphery, and an attachment edge disposed upon said back surface immediately inwardly from said outer periphery, with said outer periphery of said mat border being congruent with said periphery of said backing board; and said attachment edge of said mat border being adhesively secured congruently to said front surface of said backing board and sandwiching said display article between said mat border and said backing board.

2. The frameless picture mount according to claim 1, wherein:

said display article is secured to said backing board by means of double sided adhesive tape; and said attachment edge of said mat border is secured to said backing board by adhesive means selected from the group consisting of double sided adhesive tape and liquid adhesive.

3. The frameless picture mount according to claim 1, including:

a transparent, adhesively coated overlay disposed over said display article for protection thereof.

4. The frameless picture mount according to claim 3, including:

a second transparent, adhesively coated sheet disposed between said display article and said front surface of said backing board, for protecting said backing board from any chemicals of said display article.

5. The frameless picture mount according to claim 3, wherein:

said transparent overlay includes a periphery; and said periphery of said overlay is smaller than said periphery of said backing board and larger than said periphery of said display article.

6. The frameless picture mount according to claim 1, including:

adhesive attachment means disposed upon said back surface of said backing board, for securing said backing board to another structure.

7. A kit for a frameless picture mount, comprising:

a rigid, lightweight backing board having a front surface, a back surface opposite said front surface, and a periphery;

a plurality of central attachment tapes and a plurality of peripheral attachment tapes adhesively disposed over said front surface of said backing board;

each of said central and peripheral attachment tapes including a release sheet removably disposed thereover;

a mat border having a front surface, a back surface opposite said front surface, an outer periphery, and an attachment edge disposed upon said back surface immediately inwardly from said outer periphery, with said outer periphery of said mat border being congruent with said periphery of said backing board when assembled thereto;

a plurality of article attachment tapes and a plurality of border attachment tapes adhesively disposed over said back surface of said mat border, for securing said mat border to said backing board and for sandwiching a display article between said mat border and said backing board;

each of said article and said border attachment tapes including a release sheet removably disposed thereover; and said central and said peripheral attachment tapes of said backing board respectively aligning generally with said article and said border attachment tapes of said mat border, for securing said mat border congruently to said backing board and sandwiching a planar article therebetween when each said release sheet is removed.

8. The kit for a frameless picture mount according to claim 7, wherein:

said backing board comprises a rigid, lightweight sheet of material having a foam plastic core sandwiched between first and second sheets of coated paper.

9. The kit for a frameless picture mount according to claim 7, including:

transparent display article protection means disposed between said backing board and said mat border.

10. The kit for a frameless picture mount according to claim 9, wherein said display article protection means comprises:

a first transparent sheet, adhesively secured to said front surface of said backing board by means of said central attachment tapes adhesively secured thereto for protecting the back of the display article;

a second transparent sheet, for protecting the front of the display article; and said first and said second transparent sheet having a single joined edge.

11. The kit for a frameless picture mount according to claim 9, wherein:

said display article protection means includes a periphery; and said periphery of said display article protection means is smaller than said periphery of said backing board and larger than said periphery of said display article.

12. The kit for a frameless picture mount according to claim 7, including:

adhesive attachment means disposed upon said back surface of said backing board, for securing said backing board to another structure.

13. A frameless picture mount, comprising:

a rigid, lightweight backing board having a front surface, a back surface opposite said front surface, and a periphery;

a thin, flat, planar display article having a front surface, a back surface opposite said front surface, and a periphery, with said periphery of said display article being smaller than said periphery of said backing board;

said back surface of said display article being adhesively secured symmetrically to said front surface of said backing board with said periphery of said backing board extending evenly beyond said periphery of said display article;

a transparent, adhesively coated overlay disposed over said display article for protection thereof;

a mat border having a front surface, a back surface opposite said front surface, an outer periphery, and an attachment edge disposed upon said back surface immediately inwardly from said outer periphery, with said outer periphery of said mat border being congruent with said periphery of said backing board; and said attachment edge of said mat border being adhesively secured congruently to said front surface of said backing board and sandwiching said display article between said mat border and said backing board.

14. The frameless picture mount according to claim 13, including:

a second transparent, adhesively coated sheet disposed between said display article and said front surface of said backing board, for protecting said backing board from any chemicals of said display article.

15. The frameless picture mount according to claim 13, wherein:

said transparent overlay includes a periphery; and said periphery of said overlay is smaller than said periphery of said backing board and larger than said periphery of said display article.

* * * * *